US007998037B2

(12) United States Patent
Luquette

(10) Patent No.: US 7,998,037 B2
(45) Date of Patent: Aug. 16, 2011

(54) ADJUSTABLE RESISTANCE TRAINING APPARATUS

(75) Inventor: Mike Luquette, Lafayette, LA (US)

(73) Assignee: Spri Products, Inc., Libertyville, IL (US)

( * ) Notice: Subject to any disclaimer, the term of this patent is extended or adjusted under 35 U.S.C. 154(b) by 0 days.

(21) Appl. No.: 12/761,142

(22) Filed: Apr. 15, 2010

(65) Prior Publication Data

US 2010/0267527 A1 Oct. 21, 2010

Related U.S. Application Data

(60) Provisional application No. 61/169,341, filed on Apr. 15, 2009.

(51) Int. Cl.
*A63B 21/062* (2006.01)

(52) U.S. Cl. ..... 482/103; 482/94; 482/129

(58) Field of Classification Search ..... 482/72, 482/92–104, 121–123, 129–130, 133, 138
See application file for complete search history.

(56) References Cited

U.S. PATENT DOCUMENTS

| | | | | | |
|---|---|---|---|---|---|
| 4,666,151 | A * | 5/1987 | Chillier | 482/135 |
| 4,697,809 | A * | 10/1987 | Rockwell | 482/102 |
| 5,295,935 | A * | 3/1994 | Wang | 482/130 |
| 5,348,524 | A * | 9/1994 | Grant | 482/130 |
| 5,522,784 | A * | 6/1996 | Grant | 482/130 |
| 5,653,667 | A * | 8/1997 | Reyes | 482/121 |
| 6,042,523 | A * | 3/2000 | Graham | 482/121 |
| 6,071,217 | A * | 6/2000 | Barnett | 482/121 |
| 6,142,919 | A * | 11/2000 | Jorgensen | 482/121 |
| 6,149,554 | A * | 11/2000 | Ferguson | 482/83 |
| 6,383,122 | B1 * | 5/2002 | Graham | 482/122 |
| 6,561,956 | B1 | 5/2003 | Allison | |
| 7,192,389 | B2 | 3/2007 | Allison | |
| 7,537,554 | B2 * | 5/2009 | Zhuang | 482/142 |
| 7,563,213 | B2 * | 7/2009 | Grant | 482/129 |
| 7,850,580 | B2 * | 12/2010 | Johnson et al. | 482/92 |
| 7,887,468 | B2 * | 2/2011 | Ross et al. | 482/92 |
| 7,931,570 | B2 * | 4/2011 | Hoffman | 482/123 |
| 2007/0298944 | A1 * | 12/2007 | Habing | 482/130 |

* cited by examiner

*Primary Examiner* — Loan Thanh
*Assistant Examiner* — Daniel Roland
(74) *Attorney, Agent, or Firm* — Barnes & Thornburg LLP

(57) ABSTRACT

An adjustable resistance training apparatus that is provided with one or more elongated elastomeric members that are supported by a carrier. The adjustable resistance training apparatus also includes a slide that is configured to be moved along a guided path in response to a force exerted by a user's body. The slide includes an engagement member that is configured to permit selective engagement to the second end of one or more of the elastomeric members, once positioned by the carrier, to cause the selected elastomeric member or members to be stretched along a second plane in response to movement of the slide along the guided path. The adjustable resistance training apparatus can be coupled to isotonic weights in the form of a selectable weight stack that moves along a second guided path in response to a force exerted by a user's body or used with plate loaded devices. The combination of resistance tubes and weights results in progressive resistance regardless of the speed of movement of the weight stack.

24 Claims, 8 Drawing Sheets

ADJUSTABLE RESISTANCE TRAINING APPARATUS

This application claims priority to U.S. Provisional Application Ser. No. 61/169,341, filed Apr. 15, 2009, which is herein incorporated by reference in its entirety.

FIELD OF THE DISCLOSURE

The present disclosure relates to resistance training apparatuses and particularly to resistance training apparatuses that use rubber resistance exercise tubes.

BACKGROUND

Use of rubber resistance exercise tubes in connection with a wide variety of exercises is well known in the health and fitness industry. Elastomeric members of this type can be used as part of an exercise training regimen. The rubber resistance exercise tubes are in the form of hollow tubes or solid elastomeric members that provide resistance in response to stretching of the tubes or other elastomeric members. The amount of resistance typically depends upon the thickness, length, and diameter of the elastomeric members. The resistance provided by the exercise tubes does not overload the muscles at the beginning of movement and provides for an increasing resistance throughout the movement. Structures and other devices can be secured to the resistance tubes to provide exercise features and options.

SUMMARY

According to the present disclosure, an adjustable resistance training apparatus includes one or more elongated elastomeric members. The elastomeric members are supported by a carrier that is configured to orient the elastomeric members in a spaced apart relationship to each other. The carrier is adapted to permit movement of the elastomeric members along a first plane and includes a retainer for retaining the first ends of the elastomeric members to the carrier.

In illustrative embodiments, the adjustable resistance training apparatus also includes a slide that is configured to be moved along a guided path in response to a force exerted by a user's body, such as by movement of their arms, legs, or torso. The slide includes an engagement member that is configured to permit selective engagement to the second end of one or more of the elastomeric members, once positioned by the carrier, to cause the selected elastomeric member or members to be stretched along a second plane in response to movement of the slide along the guided path.

In illustrative embodiments, the adjustable resistance training apparatus can be coupled to isotonic weights in the form of a selectable weight stack that moves along a second guided path in response to a force exerted by a user's body or used with plate loaded devices. The slide of the adjustable resistance training apparatus is coupled to the lift rod of the weight stack to allow for stretching of an elastomeric member in response to movement of the lift rod and weight plates. The combination of resistance tubes and weights results in progressive resistance regardless of the speed of movement of the weight stack.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
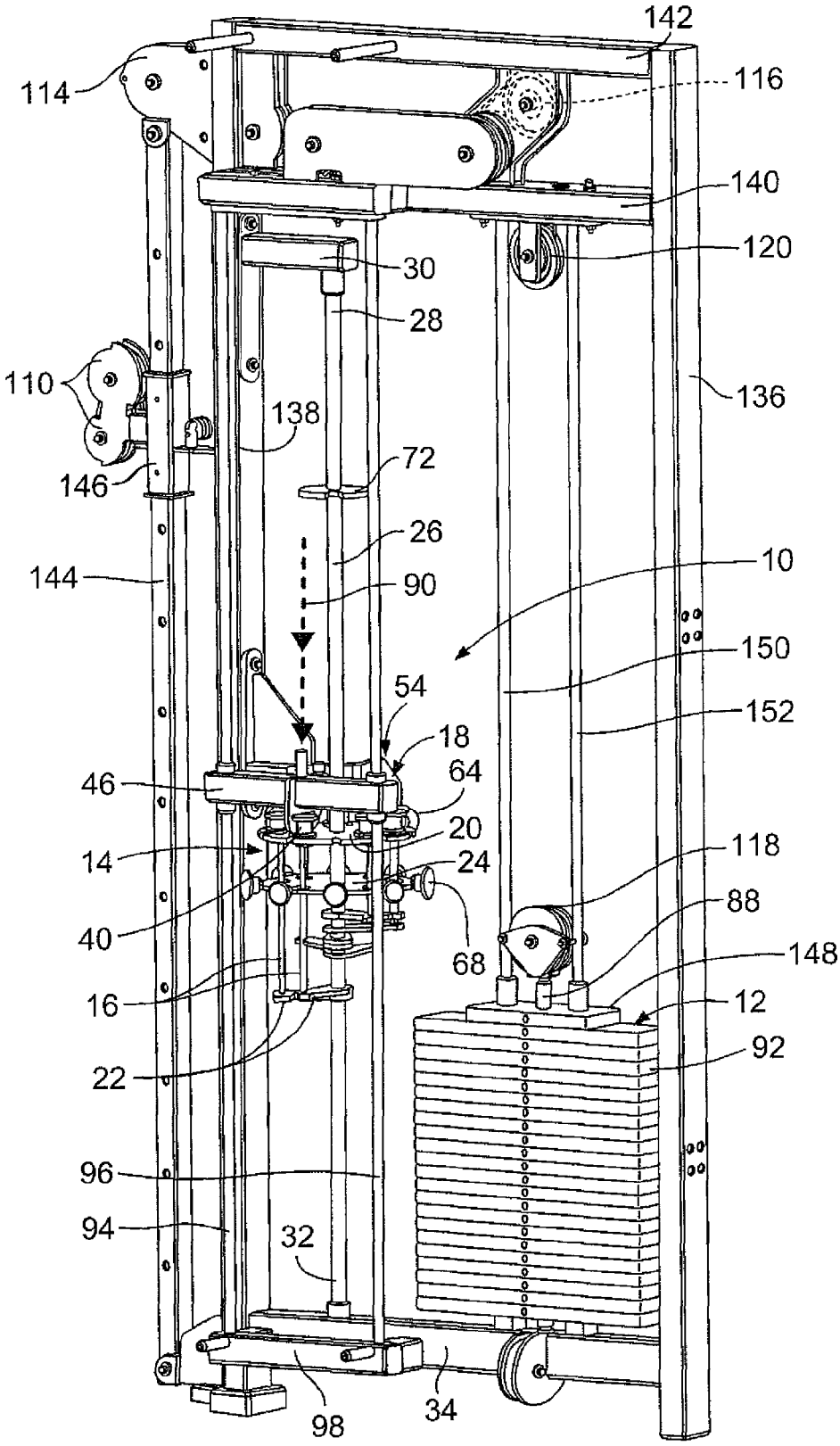
FIG. 1 is a perspective view of an adjustable resistance training apparatus in accordance with the present disclosure, positioned to lie near a weight stack and showing a rotary carrier having a series of vertically oriented elastomeric members and thimbles positioned around a rotatable support shaft and also showing a slide bar in a first position engaging one of the thimbles attached to the elastomeric members.

While the present disclosure may be susceptible to embodiments in different forms, there is shown in the drawings, and herein will be described in detail, an embodiment with the understanding that the present description is to be considered an exemplification of the principles of the disclosure and is not intended to limit the disclosure to the details of construction and the arrangements of components set forth in the following description or illustrated in the drawings.

Figure 7:
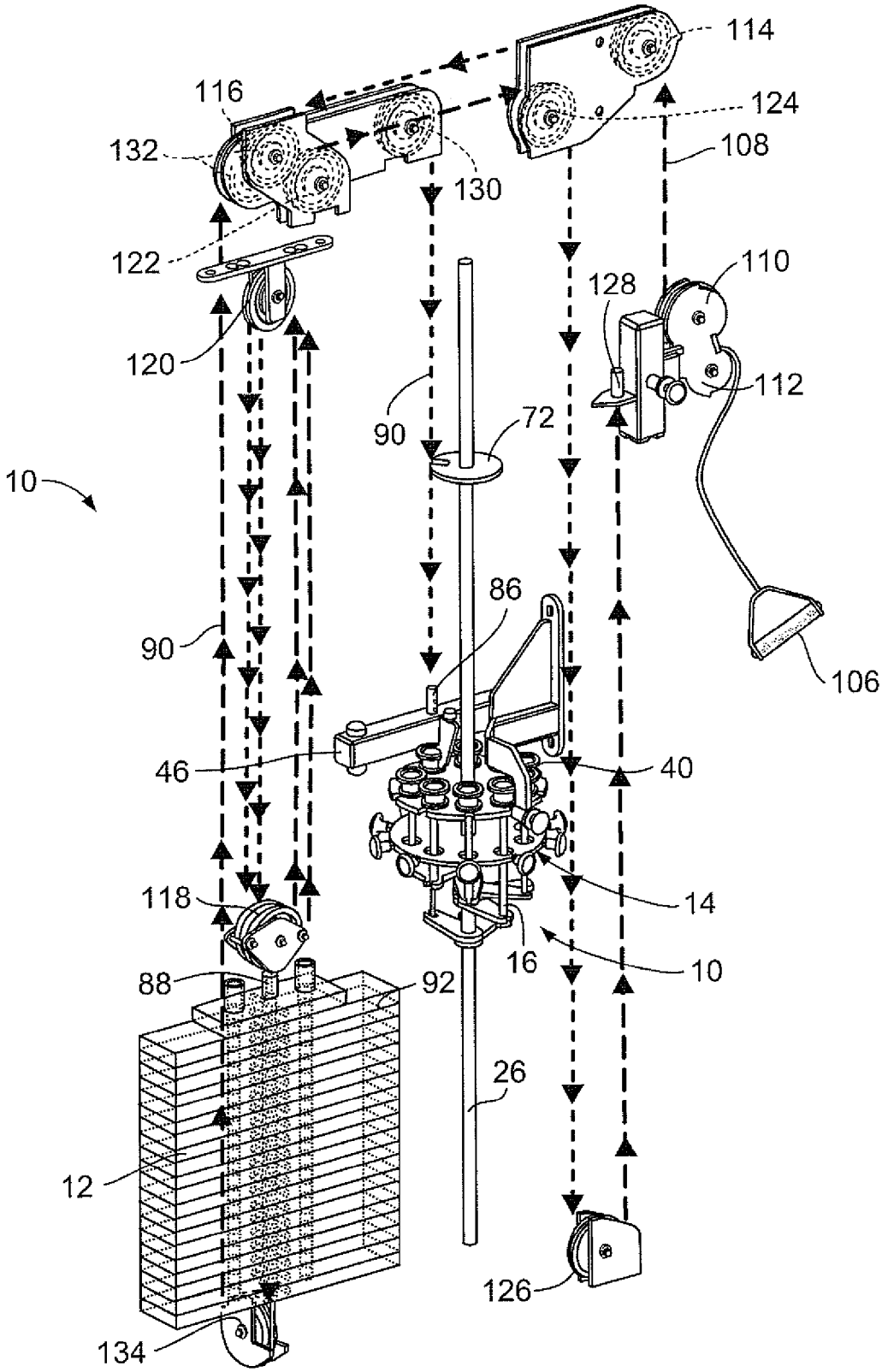
FIG. 7 is a perspective view of the adjustable resistance training apparatus positioned to lie near a weight stack showing the routing of a first cable to connect the weight stack to an exercise handle and a second cable to connect the adjustable resistance training apparatus to the lift rod of the weight stack.

An adjustable resistance training apparatus 10 is shown connected in series to an adjustable weight stack 12, as shown, for example in FIGS. 1 and 7. The adjustable resistance training apparatus 10 can be used alone or in combination with adjustable weight stack 12. Alternatively, the weight stack can be used without the adjustable resistance training apparatus 10. Adjustable resistance training apparatus 10 includes a carrier 14 having a series of elastomeric resistance tubes 16, and a slide unit 18 that works with carrier 14 to selectively engage and stretch resistance tubes 16. While rubber resistance tubing is shown in the illustrative embodiments, it is contemplated that other materials can also be used to create resistance including solid rubber, bungee cords and the like.

Carrier 14, as shown in the illustrative embodiments, is a rotary device that is configured to allow a user to select a desired resistance tube 16 by rotating carrier 14 in a circular motion, as shown in FIG. 1. Carrier 14 functions similar to a carrousel or lazy susan and is configured to move resistance tubes 16 into a desired position so that they can be engaged by slide unit 18. While a rotary carrier 14 is shown in the illustrative embodiments, it is contemplated that a linear carrier could also be used to permit movement of resistance tubes 16 in a horizontal plane. Carrier 14 is designed with an empty space that does not include a resistance tube 14 so that the weight stack 12 can be used without the resistance training apparatus 10.

Figure 3:
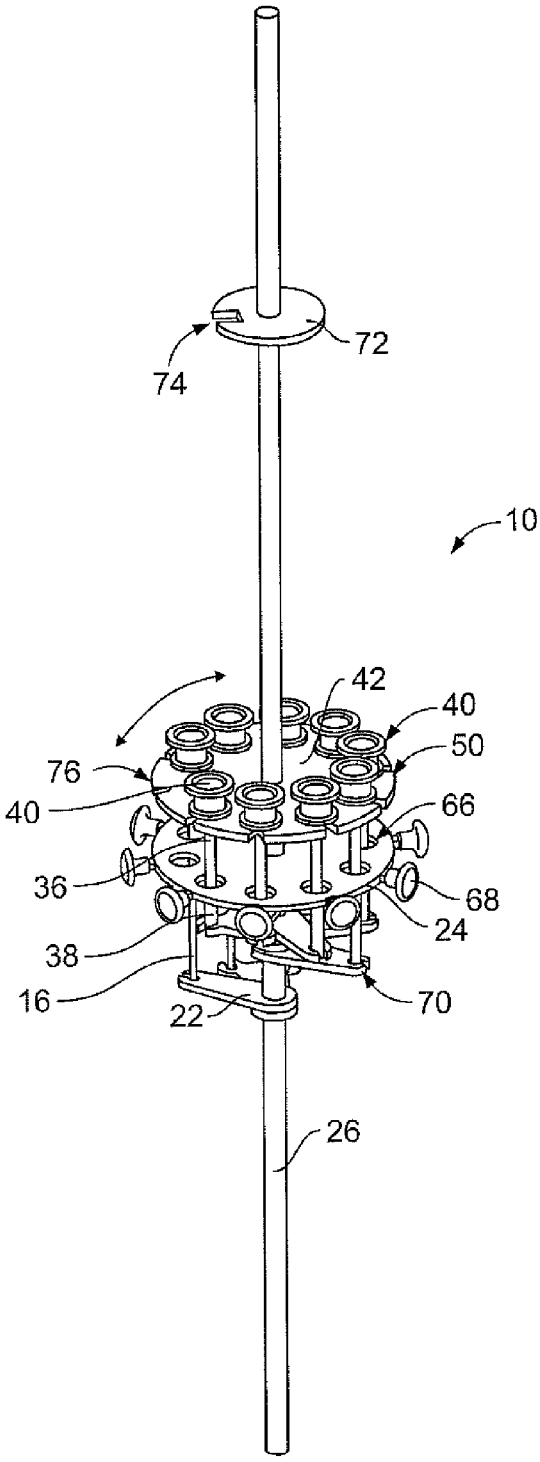
FIG. 3 is an enlarged perspective view of the carrier showing the series of elastomeric members positioned around the rotatable support shaft, the elastomeric members secured at a first end to a series of retainer anchors and a thimble support plate for supporting the thimbles that are attached to the upper end of the elastomeric members.

Carrier 14 includes thimble support plate 20, a series of retainers 22, and an adjustment plate 24 positioned between the thimble support plate 20 and retainers 22, as shown in FIGS. 1 and 3. Thimble support plate 20, retainers 22, and adjustment plate 24 are each coupled to rotatable support shaft 26. Rotatable support shaft 26, in the illustrative embodiment, is vertically oriented and pivotally coupled at an upper end 28 to support bracket 30 and at a lower end 32 to support bar 34. Rotation of carrier 14 causes rotation of rotatable support shaft 26.

Figure 3A:
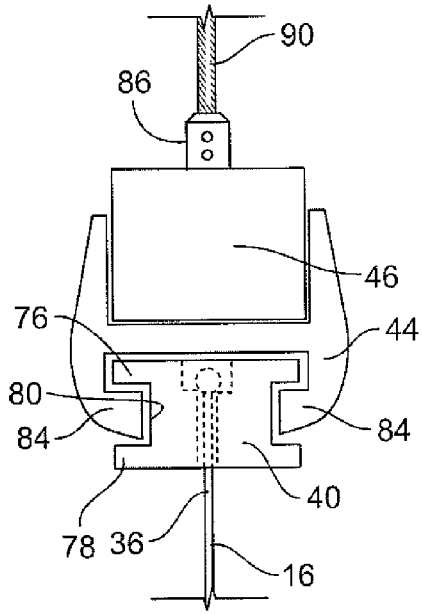
FIG. 3*a* is a side elevational view of the slide bar shown engaging a thimble with a gripper having a pair of jaws.

Resistance tubes 16 are vertically oriented and positioned around rotatable support shaft 26, as shown in FIG. 3. While vertically oriented tubes are shown, resistance tubes 16 could also be horizontally oriented or oriented at an angle. Resistance tubes 16 are tubular rubber members that are of various lengths, thicknesses, and diameters to vary the resistance between resistance tubes 16. Resistance tubes 16 each have a first end 36 that is coupled to retainers 22 and a second end 38 that is coupled to thimbles 40. Thimbles 40 are spool shaped members that are coupled to one end of resistance tubes 16 and are configured to lie on top surface 42 of thimble support plate 20. Thimbles 40 are configured to be engaged and lifted by gripper 44 on slide bar 46 of slide unit 18, as shown in FIG. 3*a*.

Figure 4:
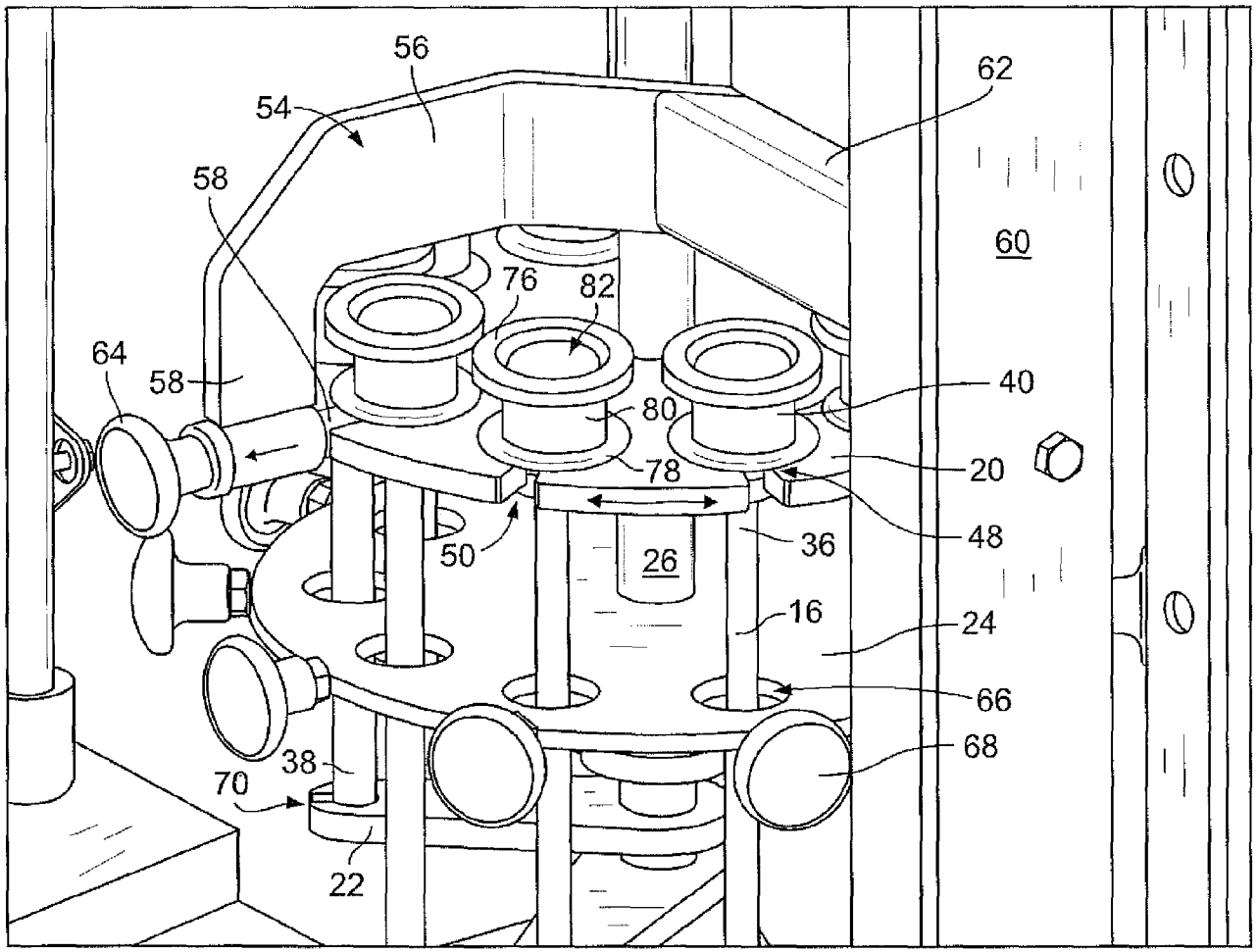
FIG. 4 is another enlarged perspective view showing the series of thimbles attached to an upper end of the elastomeric members and retained by the circular thimble support plate, and also showing a release pin and knob positioned in one of the slots formed in the thimble support plate for retaining the position of the carrier.
Figure 5:
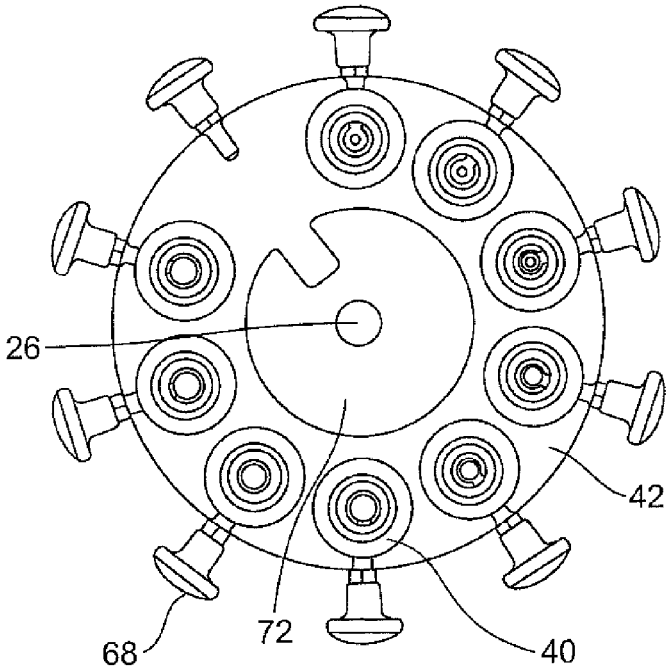
FIG. 5 is a top view of the carrier showing the series of thimbles positioned radially outwardly from the rotatable support shaft and also showing a series of knobs positioned around an adjustment plate.
Figure 6:
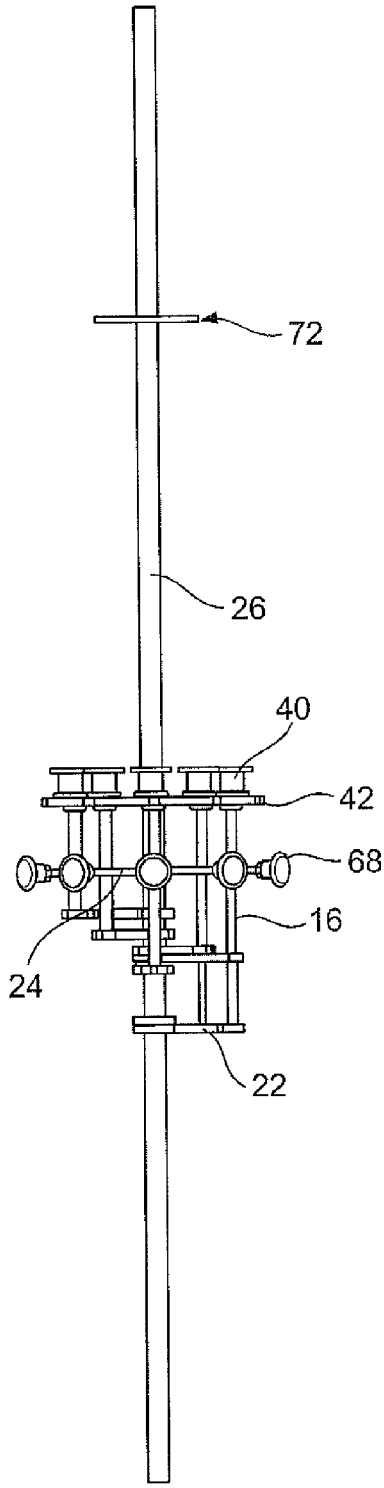
FIG. 6 is a side elevational view of the carrier and the rotatable support shaft showing a series of elastomeric members extending from staggered retainer anchors, through the adjustment plate to thimble support plate and showing a series of thimbles resting on the thimble support plate.

Thimble support plate 20 of carrier 14 is positioned above retainers 22 and is configured to support thimbles 40 that are coupled to the upper end 28 of resistance tubes 16, as shown in FIG. 4. Thimble support plate 20 is circular in shape and includes a series of openings 48 sized large enough to permit the passage of resistance tubes 16 but small enough to prevent the passage of thimbles 40. Thimble support plate 20 also includes a series of notches 50 positioned to lie near openings 48. Notches 50 are configured to accept locking pin 52 of locking unit 54.

Locking unit 54 includes support arm 56 that is coupled to spring loaded locking pin 52 at a first end 58 and to a vertical support arm 60 at a second end 62, as shown in FIG. 4. Locking unit 54 includes a knob 64. Knob 64 is used to disengage locking pin 52 from notch 50 in thimble support plate 20 to allow thimble support plate 20 to be rotated. Once a desired resistance tube 16 is selected, knob 64 can be released to cause locking pin 52 to engage notch 50.

Adjustment plate 24 of carrier 14 is positioned below thimble support plate 20, as shown in FIG. 4. Adjustment plate 24 includes a series of openings 66 that are adapted to permit the passage of resistance tubes 16. Adjustment plate 24 also includes a series of adjustment knobs 68 positioned around the perimeter of adjustment plate 24. In this embodiment, there is one adjustment knob 68 per resistance tube 16. Adjustment knobs 68 aid a user in rotating and positioning carrier 14.

Retainers 22 of carrier 14 are in the form of a series of arms that extend at different height intervals from rotatable support shaft 26, as shown in FIG. 3. Retainers 22 secure second end 38 of resistance tubes 16. The position of retainers 22 is dependent upon the length of a particular resistance tube. Retainers 22 include a notch 70 that is used to permit the changing of resistance tubes 16 should the tubes need to be replaced.

Rotatable support shaft 26 includes a safety stop 72 positioned above thimble support plate 20, as shown in FIG. 3. Safety stop 72 limits the range of movement of slide bar 46 to prevent overstretching of elastomeric tubes 16. Safety stop 72 includes a notch 74 that permits gripper 44 of slide bar 46 to pass safety stop 72 when no elastomeric tube is selected. Carrier 14 is designed with a vacancy, as designated by arrow 76, which allows adjustable weight stack 12 to be used alone without the adjustable resistance training apparatus 10.

Thimbles 40 are coupled to first end 36 of elastomeric tubes 16 and are configured to be engaged by gripper 44 of slide bar 46, as shown in FIG. 3*a*. Thimbles 40 each include a top flange 76, a spaced apart bottom flange 78 and a mid-region 80. Thimbles 40 also include a central bore 82 configured to permit the passage of elastomeric tube 16. End of elastomeric tube 16 is tied or plugged to lock tube to thimble 40.

Gripper 44 includes a pair of jaws 84 that are configured to be positioned within mid-region 80 beneath top flange 76 of thimbles 40, as shown in FIG. 3*a*. When slide bar 46 is raised, jaws 84 engage top flange 76 to cause thimble 40 to be raised and elastomeric tube 16 to be stretched. If no tube 16 is selected then slide bar 46 moves upwardly without stretching a tube. The space between gripper 44 and thimble 40 permit the thimbles 40 to pass through gripper 44 as carrier 14 is rotated. Slide bar 46 includes a cable fitting 86 that allows slide bar 46 to be coupled to a cable 90, as shown in FIG. 7.

Figure 2:
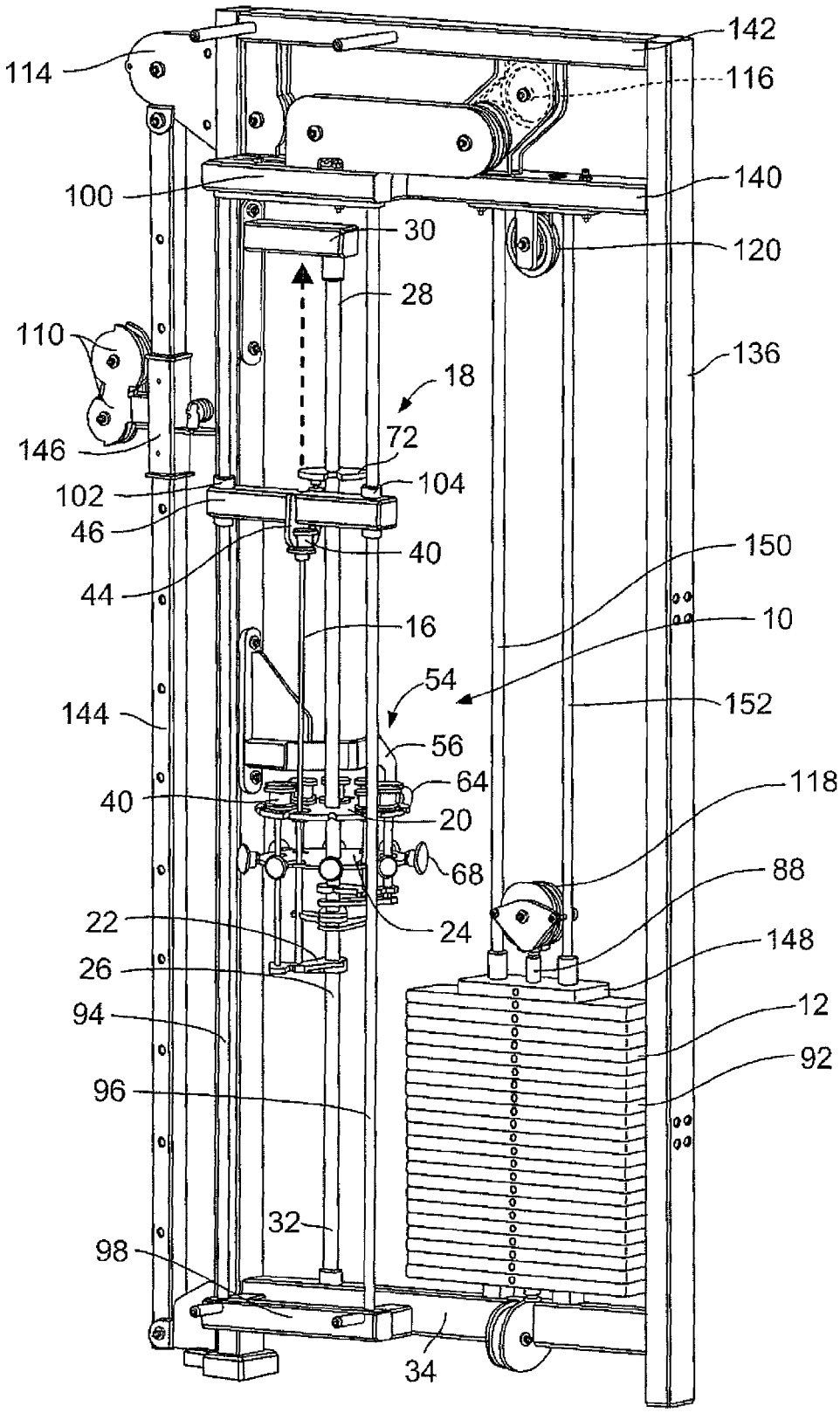
FIG. 2 is a perspective view similar to FIG. 1 showing the slide bar in a second position stretching one of the elastomeric members.

Slide unit 18 includes slide bar 46 that is coupled to the bottom of a lift rod 88 of adjustable weight stack 12 by use of cable 90, as shown in FIG. 7. Lift rod 88 includes a series of openings that correspond to openings in the weight plates 92 of the weight stack. To select a desired amount of weight, a user inserts a locking pin into an opening in a weight plate 92. Slide bar 46 of slide unit 18 moves along a guided path controlled by guide rods 94, 96, as shown in FIG. 2. While slide unit is configured to stretch one tube, it is contemplated that slide unit could also stretch multiple tubes at the same time to increase resistance.

Guide rods 94, 96 of the disclosed embodiment are parallel and vertically oriented, as shown in FIG. 2. Guide rods 94, 96 are secured at a lower end by a lower bar bracket 98 and are secured at an upper end by an upper bar bracket 100. Slide bar 46 includes guides 102, 104 that slide along guide rods 94, 96. While guide rods 94, 96 are shown oriented in a vertical direction it is contemplated that they can be mounted in a horizontal direction to match a set of horizontally extending elastomeric tubes 16.

Adjustable resistance training apparatus 10 is combined with a cable system that is configured to couple a handle 106 or other exercise device to the adjustable resistance training apparatus 10 and the adjustable weight stack 12, as shown in FIG. 7. Handle 106 is coupled to lift rod 88 by use of cable 108. Pulling handle 106 causes upward movement of lift rod 88, the selected weight plates 92, and slide bar 46 to cause the stretching of a selected elastomeric tube 16.

Cable 108 extends from handle 106 through adjustable pulleys 110, 112, over a first set of top pulleys 114, 116 and down to double pulley 118, which is attached to lift rod 88, as shown in FIG. 7. Cable 108 passes over lift pulley 120, back around double pulley 118 and up and over a second set of top pulleys 122, 124. Cable 108 next passes under bottom pulley 126 and is secured to cable clamp 128.

Cable 90 couples slide bar 46 of adjustable resistance training apparatus 10 to lift rod 88 of weight stack 12, as shown in FIG. 7. Cable 90 is coupled to cable fitting 86 at a first end and passes over upper pulleys 130, 132. Cable 90 next passes under bottom pulley 134 and connects to the bottom of lift rod 88. Movement of lift rod 88 in an upward direction causes upward movement of slide bar 46.

Strength training device, which includes adjustable resistance training apparatus 10 and adjustable weight stack 12 includes vertical frame members 136, 138 and upper horizontal frame members 140, 142. Training device also includes outboard frame member 144, which includes adjustable collar 146. Pulleys 110 are coupled to adjustable collar 146. Adjustable weight stack 12 includes slide 148 and guide rods 150, 152 to guide weight stack 12 along a linear path. While a weight stack system is shown, it is contemplated that the adjustable resistance training apparatus can be used with all forms of mass-based load strength conditioning devices.

In use, a user pulls out knob 64 of carrier 14 to disengage pin 52 from notch 50 of thimble support plate 20, as shown in FIG. 4. Once pin 52 is disengaged from slot 50, the user grabs one of the knobs 68 and rotates carrier 14 in a horizontal plane until a desired resistance tube 16 is selected. Once a desired resistance tube 16 is selected, the user releases knob 64 to lock pin 52 within the slot 50 of thimble support plate 20. Selecting a tube causes the corresponding thimble 40 of the tube to be positioned within gripper 44 of slide bar 46. If the user decides to not incorporate the rubber resistance training into their workout then the carrier 14 is positioned so that no tube is selected.

Once the desired resistance tube 16 is selected, a user next selects the number of weight plates 92 they wish to lift. Once the desired weight is selected, the user begins their workout by pulling handle 106, as shown in FIG. 7. Pulling handle 106 causes weight plates 92 and lift rod 88 to be raised, which in turn causes slide bar 46, gripper 44, and thimble 40 to go upward in a vertical plane, stretching the selected resistance tube 26. If the user did not select a resistance tube 16 then only the slide bar 46 and gripper 44 move with movement of handle 106.

Figure 8:
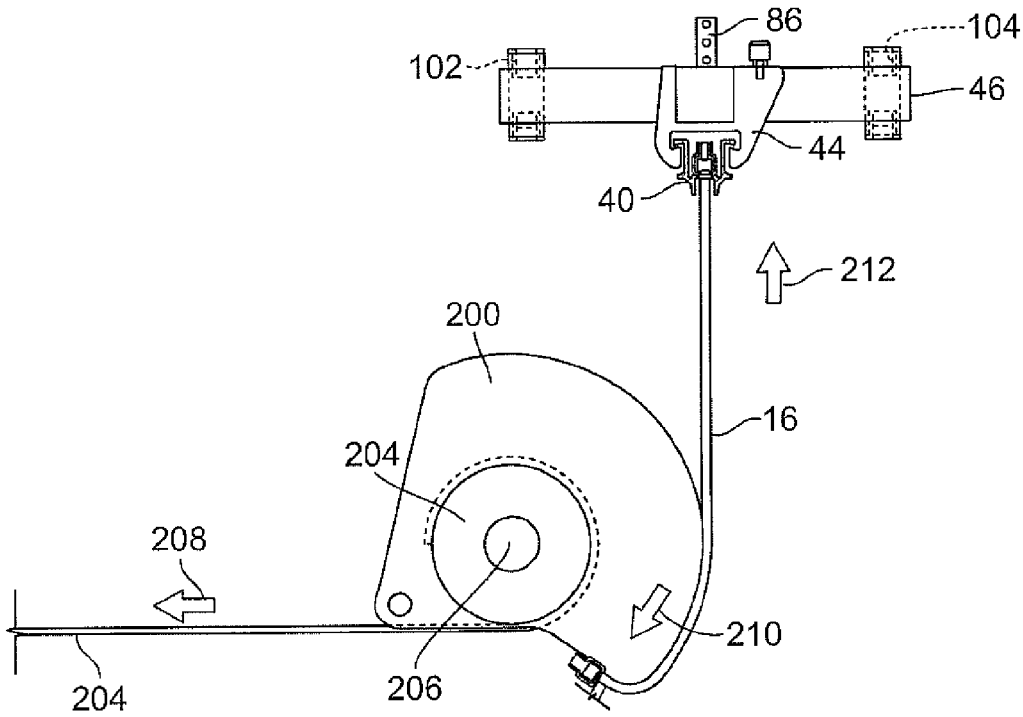
FIG. 8 is another embodiment of the adjustable resistance training apparatus showing an adjustable cam member that elongate the elastomeric member, which is stretched by the slide bar.

In another embodiment, a cam member 200 is used to elongate resistance tube 16, as shown, for example, in FIG. 8. Rotation of cam 200 is caused by drive wheel 202, which is coupled to adjustment cable 204. Drive wheel 202 and cam 200 rotate about shaft 206 in response to movement of cable 204. Pulling cable 204 in direction 208 causes clockwise rotation of drive wheel 202 and cam 200 in direction 210 to cause elongation of resistance tube 16. Once a proper cam position is selected, slide bar 46 and gripper 44 together stretch resistance tube 16 in direction 212 during a workout.

Figure 9:
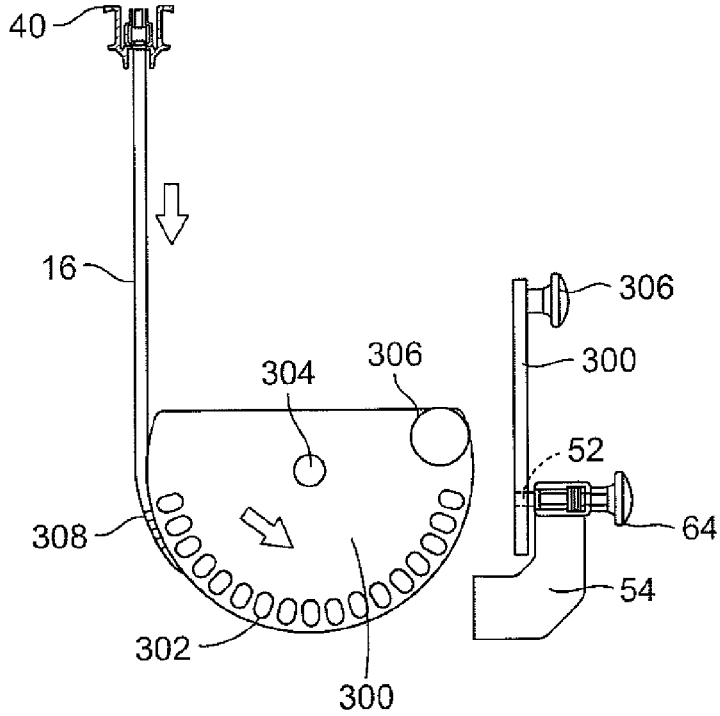
FIG. 9 is another embodiment of the adjustable resistance training apparatus showing a curved resistance plate having a series of openings to allow for elongation of the elastomeric member, which is stretched by the slide bar.

In yet another embodiment, a curved resistance plate 300 is used to elongate resistance tube 16, as shown, for example, in FIG. 9. Resistance plate 300 includes a series of openings 302 that are configured to accept pin 52 of knob 64. Resistance plate 300 rotates about shaft 304 to cause the elongation of resistance tube 16. Resistance plate 300 includes knob 306 to allow resistance plate 300 to be rotated about shaft 304 when knob 64 is pulled. Resistance tube 16 is coupled to resistance plate 300 at end 308. Once resistance plate 300 is moved to a desired position, resistance tube 16 can be stretched by slide bar 46. If no opening 302 is selected, resistance plate 300 is free to rotate with movement of resistance tube 16.

Figure 10:
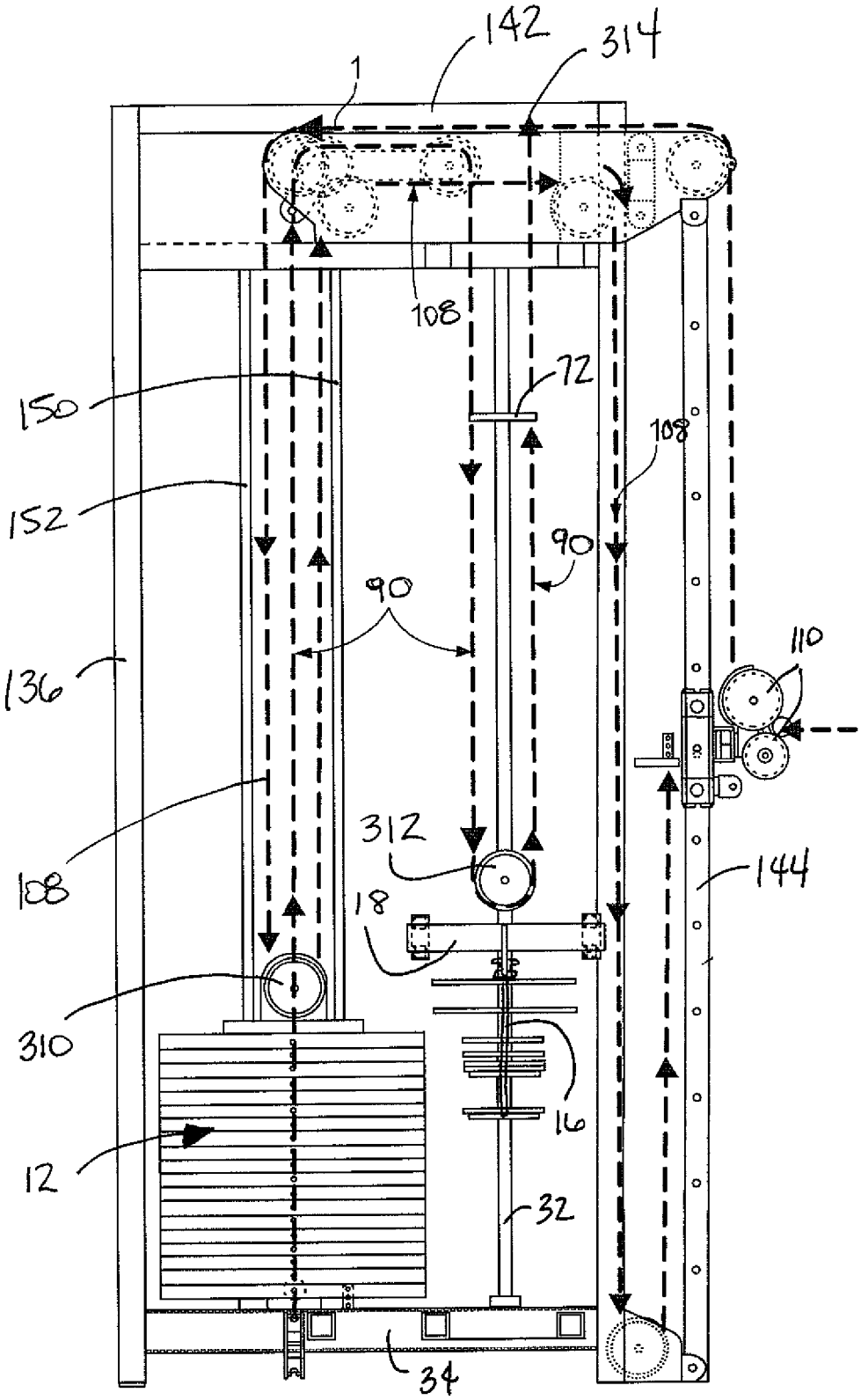
FIG. 10 is another embodiment showing the use of a single pulley coupled to the top of the weight stack creating a 2:1 ratio for the weight stack and a single pulley coupled to the slide bar of the adjustable resistance training apparatus for a 2:1 ratio for the slide bar.

In another embodiment, a single pulley 310 is coupled to weight stack 12 and is connected to cable 108, as shown, for example, in FIG. 10. The use of single pulley 310 creates a 2:1 ratio when lifting weight stack 12 with cable 108. In this embodiment, adjustable resistance training apparatus 10 includes a single pulley 312 that is coupled to slide unit 18 that works with cable 90 to stretch resistance tubes 16. Cable 90 instead of terminating at slide unit 18, terminates at location 314 at upper horizontal frame member 142. The use of pulleys 310, 312 changes the lifting characteristics of weight stack 12 and adjustable resistance training apparatus 10.

Various features of the disclosure have been shown and described in connection with the illustrated embodiment, however, it is understood that these arrangements merely illustrate, and that the disclosure is to be given its fullest interpretation.

What is claimed is:

1. An adjustable resistance training apparatus comprising:

a carrier;

a series of elongated elastomeric members that are supported by the carrier to orient the elastomeric members in a spaced apart relationship to each other;

a slide member, the carrier moveable relative to the slide member to cause movement of the elastomeric members relative to the slide member along a first plane for selecting one or more of the elastomeric members, the slide member configured to be moved along a guided path in response to a force exerted by a user, the slide includes an engagement member that is configured to permit selective engagement to said one or more of the elastomeric members to cause the selected one or more elastomeric member or members to be stretched along a second plane in response to movement of the slide along the guided path; and wherein the adjustable resistance training apparatus is coupled to isotonic weights in the form of a selectable weight stack that moves along a guided path in response to a force exerted by the user.

2. The adjustable resistance training apparatus of claim 1, wherein the slide member is coupled to a lift rod of the weight stack to allow for stretching of a selected elastomeric member in response to movement of the lift rod and weight stack.

3. The adjustable resistance training apparatus of claim 1, wherein the carrier includes at least one retainer for retaining a first end of at least one of the elastomeric members to the carrier.

4. An adjustable resistance training apparatus comprising:

a carrier;

a series of elongated elastomeric members that are supported by the carrier to orient the elastomeric members in a spaced apart relationship to each other, the carrier is configured to permit movement of the elastomeric members along a first plane; and a slide member that is configured to be moved along a guided path in response to a force exerted by a user, the slide includes an engagement member that is configured to permit selective engagement to one or more of the elastomeric members to cause the selected elastomeric member or members to be stretched along a second plane in response to movement of the slide along the guided path;

wherein the carrier includes at least one retainer for retaining a first end of at least one of the elastomeric members to the carrier; and wherein the carrier is a rotary device that is configured to allow a user to select a desired elastomeric member by rotating the carrier in a circular motion.

5. The adjustable resistance training apparatus of claim 3, wherein the carrier moves linearly to permit movement of the elastomeric members in the first plane.

6. The adjustable resistance training apparatus of claim 4, wherein the carrier includes a thimble support plate, a series of retainers, and an adjustment plate positioned between the thimble support plate and the retainers, wherein the thimble support plate, the retainers, and the adjustment plate are each coupled to a support shaft.

7. The adjustable resistance training apparatus of claim 6, wherein the elastomeric members are positioned around the support shaft.

8. The adjustable resistance training apparatus of claim 7, wherein the elastomeric members each have a first end that is coupled to the retainers and a second end that is coupled to a series of thimbles.

9. The adjustable resistance training apparatus of claim 8, wherein the thimbles are configured to lie near the thimble support plate.

10. The adjustable resistance training apparatus of claim 9, wherein the thimbles are configured to be engaged and lifted by a gripper of the slide member to permit the elastomeric members to be stretched as one of the thimbles is raised from the thimble support plate.

11. The adjustable resistance training apparatus of claim 6, wherein the retainers are in the form of a series of arms that extend radially outwardly from the support shaft at different intervals along the length of the support shaft.

12. An adjustable resistance training apparatus comprising:

a carrier;

a series of elongated elastomeric members that are supported by the carrier to orient the elastomeric members in a spaced apart relationship to each other; and a slide member, the carrier moveable relative to the slide member to cause movement of the elastomeric members relative to the slide member along a first plane for selecting one or more of the elastomeric members, the slide member configured to be moved along a guided path in response to a force exerted by a user, the slide includes an engagement member that is configured to permit selective engagement to said one or more of the elastomeric members to cause the selected one or more elastomeric member or members to be stretched along a second plane in response to movement of the slide along the guided path; and further including a locking unit that is configured to lock the position of the carrier when the desired elastomeric member is selected when in a first position and to release the position of the carrier when in a second position.

13. An adjustable resistance training apparatus comprising:

a rotatable carrier;

a series of elongated elastomeric members that are supported by the carrier to orient the elastomeric members in a spaced apart relationship to each other; and a slide member, the carrier rotatable relative to the slide member to cause movement of the elastomeric members relative to the slide member along a first plane for selecting one or more of the elastomeric members, the slide member configured to be moved along a guided path in response to a force exerted by a user, the slide includes an engagement member that is configured to permit selective engagement to said one or more of the elastomeric members to cause the selected one or more elastomeric member or members to be stretched along a second plane in response to movement of the slide along the guided path; and wherein the adjustable resistance training apparatus is coupled to isotonic weights in the form of a selectable weight stack that moves along a second guided path in response to a force exerted by the user.

14. The adjustable resistance training apparatus of claim 13, wherein the slide member is coupled to a lift rod of the weight stack to allow for stretching of a selected elastomeric member in response to movement of the lift rod and weight stack.

15. The adjustable resistance training apparatus of claim 13, wherein the carrier includes at least one retainer for retaining a first end of one of the elastomeric members to the carrier.

16. The adjustable resistance training apparatus of claim 13, wherein the carrier has a linear movement to permit movement of the elastomeric members in the first plane.

17. An adjustable resistance training apparatus comprising:

a rotatable carrier;

a series of elongated elastomeric members that are supported by the carrier to orient the elastomeric members in a spaced apart relationship to each other, the carrier is configured to permit movement of the elastomeric members along a first plane;

a slide member that is configured to be moved along a guided path in response to a force exerted by a user, the slide includes an engagement member that is configured to permit selective engagement to one or more of the elastomeric members to cause the selected elastomeric member or members to be stretched along a second plane in response to movement of the slide along the guided path;

wherein the adjustable resistance training apparatus is coupled to isotonic weights in the form of a selectable weight stack that moves along a second guided path in response to a force exerted by the user; and wherein the carrier is a rotary device that is configured to allow a user to select a desired elastomeric member by rotating the carrier in a circular motion.

18. The adjustable resistance training apparatus of claim 17, wherein the carrier includes a thimble support plate, a series of retainers, and an adjustment plate positioned between the thimble support plate and the retainers wherein the thimble support plate, the retainers, and the adjustment plate are each coupled to a support shaft.

19. The adjustable resistance training apparatus of claim 18, wherein elastomeric members are positioned around the support shaft.

20. The adjustable resistance training apparatus of claim 19, wherein the elastomeric members each have a first end that is coupled to the retainers and a second end that is coupled to a series of thimbles.

21. The adjustable resistance training apparatus of claim 20, wherein the thimbles are configured to lie near the thimble support plate.

22. The adjustable resistance training apparatus of claim 21, wherein the thimbles are configured to be engaged and lifted by a gripper of the slide member to permit the elastomeric members to be stretched as one of the thimbles is raised from the thimble support plate.

23. The adjustable resistance training apparatus of claim 18, wherein the retainers are in the form of a series of arms that extend radially outwardly from support shaft at different intervals along the length of the support shaft.

24. An adjustable resistance training apparatus comprising:

a rotatable carrier;

a series of elongated elastomeric members that are supported by the carrier to orient the elastomeric members in a spaced apart relationship to each other, the carrier is configured to permit movement of the elastomeric members along a first plane;

a slide member that is configured to be moved along a guided path in response to a force exerted by a user, the slide includes an engagement member that is configured to permit selective engagement to one or more of the elastomeric members to cause the selected elastomeric member or members to be stretched along a second plane in response to movement of the slide along the guided path;

wherein the adjustable resistance training apparatus is coupled to isotonic weights in the form of a selectable weight stack that moves along a second guided path in response to a force exerted by the user; and a locking unit that is configured to lock the position of the carrier when the desired elastomeric member is selected when in a first position and to release the position of the carrier when in a second position.

* * * * *